US009747764B2

(12) United States Patent
Tanaka et al.

(10) Patent No.: US 9,747,764 B2
(45) Date of Patent: Aug. 29, 2017

(54) GUIDANCE SYSTEM

(71) Applicant: TNK CORPORATION LTD., Tokyo (JP)

(72) Inventors: Nobuyuki Tanaka, Tokyo (JP); Kazuo Mishina, Tokyo (JP)

(73) Assignee: TNK CORPORATION LTD., Tokyo (JP)

( * ) Notice: Subject to any disclaimer, the term of this patent is extended or adjusted under 35 U.S.C. 154(b) by 0 days.

(21) Appl. No.: 14/896,266

(22) PCT Filed: Nov. 27, 2014

(86) PCT No.: PCT/JP2014/081355

§ 371 (c)(1),
(2) Date: Dec. 4, 2015

(87) PCT Pub. No.: WO2015/087706

PCT Pub. Date: Jun. 18, 2015

(65) Prior Publication Data

US 2016/0275761 A1 Sep. 22, 2016

(30) Foreign Application Priority Data

Dec. 11, 2013 (JP) ..... 2013-256217

(51) Int. Cl.
*G08B 17/12* (2006.01)
*G08B 7/06* (2006.01)
(Continued)

(52) U.S. Cl.
CPC ..... *G08B 7/066* (2013.01); *H05B 37/0227* (2013.01); *G06Q 90/205* (2013.01)

(58) Field of Classification Search
CPC ... G08B 7/066; H05B 37/0227; G06Q 90/205
(Continued)

(56) References Cited

U.S. PATENT DOCUMENTS 6,057,041 A 5/2000 Sumi et al.
6,150,943 A * 11/2000 Lehman ..... G08B 7/066 340/332
(Continued)

FOREIGN PATENT DOCUMENTS

JP 54-7898 A 1/1979
JP 4-137097 A 5/1992
JP 2009/017628 A 2/2009

OTHER PUBLICATIONS

International Search Report dated Feb. 19, 2015, mailed Mar. 3, 2015.
(Continued)

*Primary Examiner* — Jack K Wang
(74) *Attorney, Agent, or Firm* — Norris McLaughlin & Marcus, P.A.

(57) ABSTRACT

To provide a guidance system that can quickly guide a person along a guidance route without anxiety.
Provided are: a plurality of unit control apparatuses; and a plurality of unit light emitting apparatuses controlled by the unit control apparatuses, wherein at normal times, light emitting elements of a plurality of light emitting apparatuses of the plurality of unit light emitting apparatuses are continuously lit at an illuminance of 100%, and at guidance, the illuminance of the light emitting elements of the plurality of light emitting apparatuses of the plurality of unit display apparatuses is attenuated to 30%, and then the illuminance of the light emitting elements of the plurality of light emitting apparatuses of the plurality of unit display apparatuses is sequentially controlled to 100% based on count values stored in an emergency exit number count value storage unit to generate an optical flow toward a guidance direction.

11 Claims, 10 Drawing Sheets

(51) Int. Cl.

| | |
|---|---|
| ***H05B 37/02*** | (2006.01) |
| *G08B 13/14* | (2006.01) |
| *G08B 19/00* | (2006.01) |
| *G08B 3/00* | (2006.01) |
| *G08B 23/00* | (2006.01) |
| *G06Q 90/00* | (2006.01) |

(58) Field of Classification Search
USPC ..... 340/577
See application file for complete search history.

(56) References Cited

U.S. PATENT DOCUMENTS

| | | | | |
|---|---|---|---|---|
| 2007/0103329 | A1* | 5/2007 | Lin | G08B 7/066 340/691.1 |
| 2009/0066522 | A1* | 3/2009 | Lee | G08B 7/066 340/577 |
| 2011/0089869 | A1* | 4/2011 | Sundholm | G08B 7/066 315/323 |
| 2012/0181934 | A1* | 7/2012 | Knibbe | G08B 7/066 315/130 |
| 2012/0286932 | A1* | 11/2012 | Lewis | G08B 7/066 340/6.1 |
| 2014/0232285 | A1* | 8/2014 | Ohki | B60Q 11/007 315/210 |

OTHER PUBLICATIONS

English Translation of International Search Report dated Feb. 19, 2015, mailed Mar. 3, 2015.

* cited by examiner

[FIG. 1]
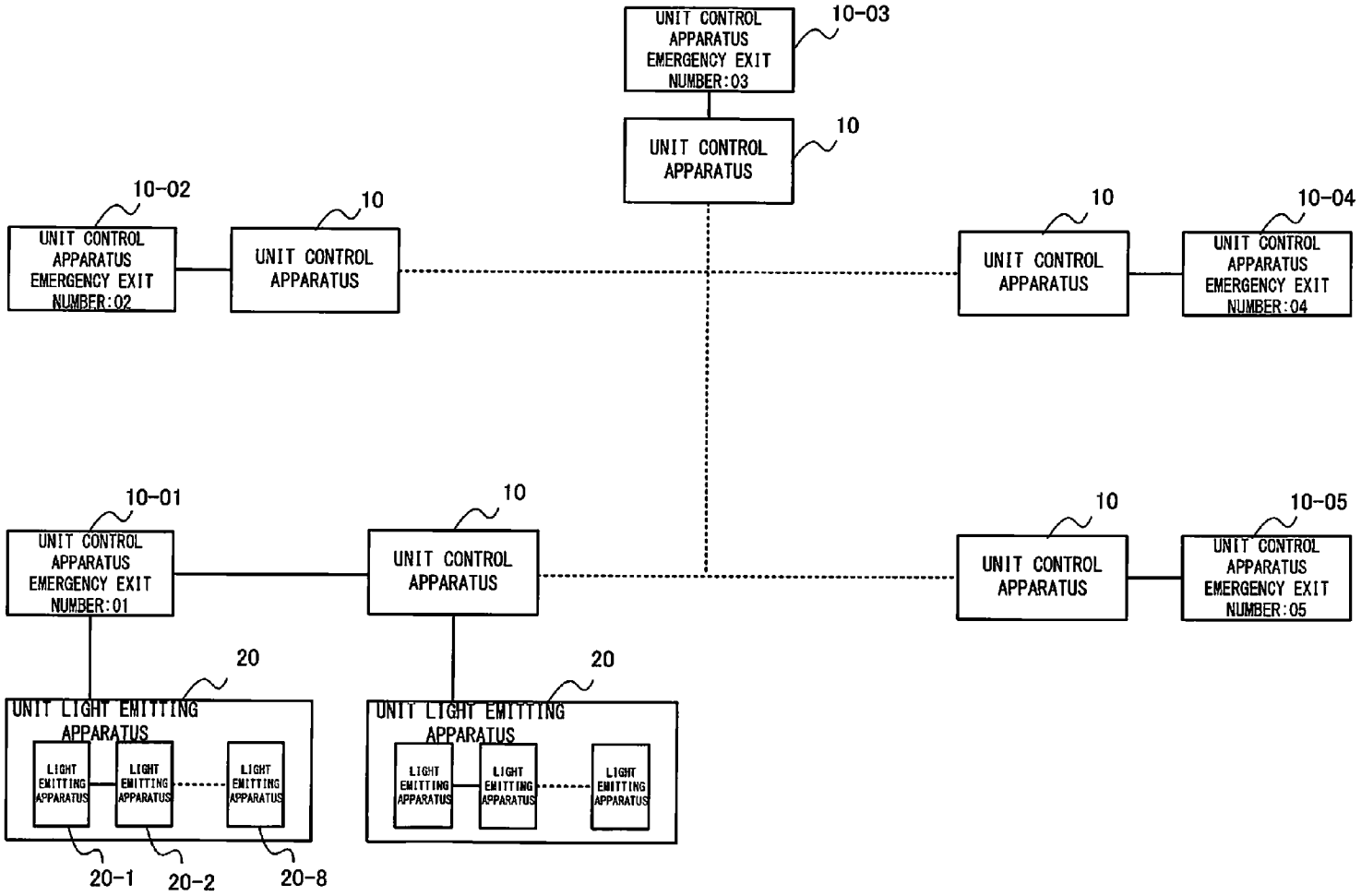

[FIG. 2]
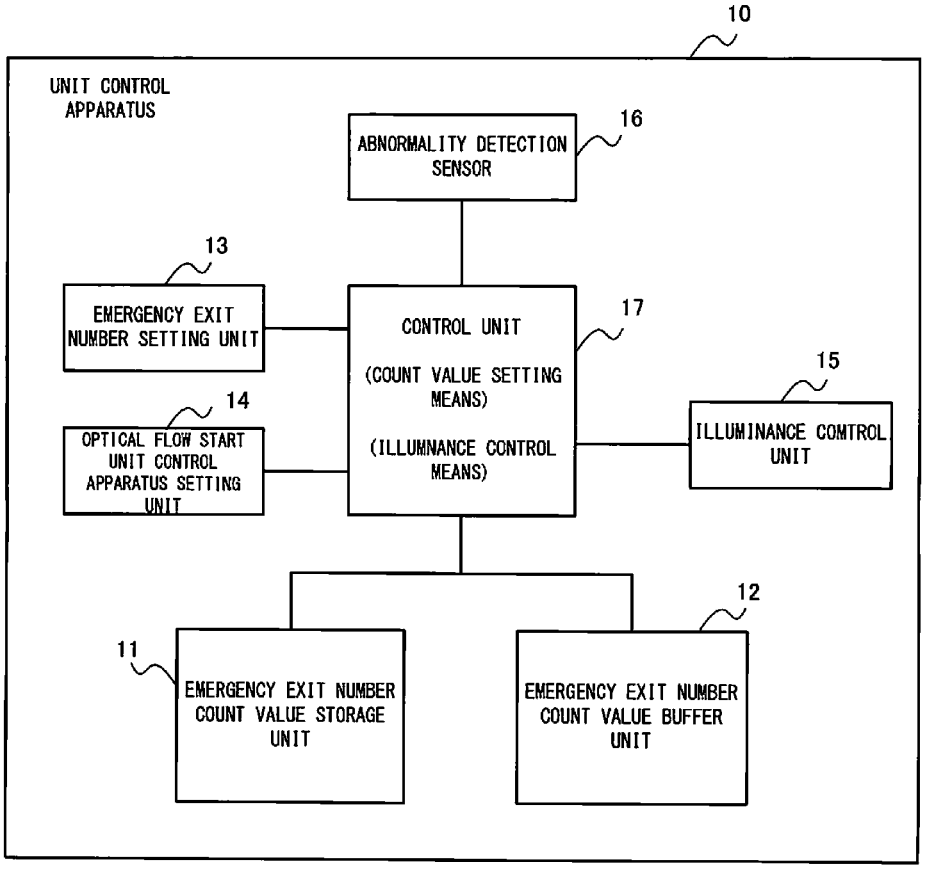

[FIG. 3]
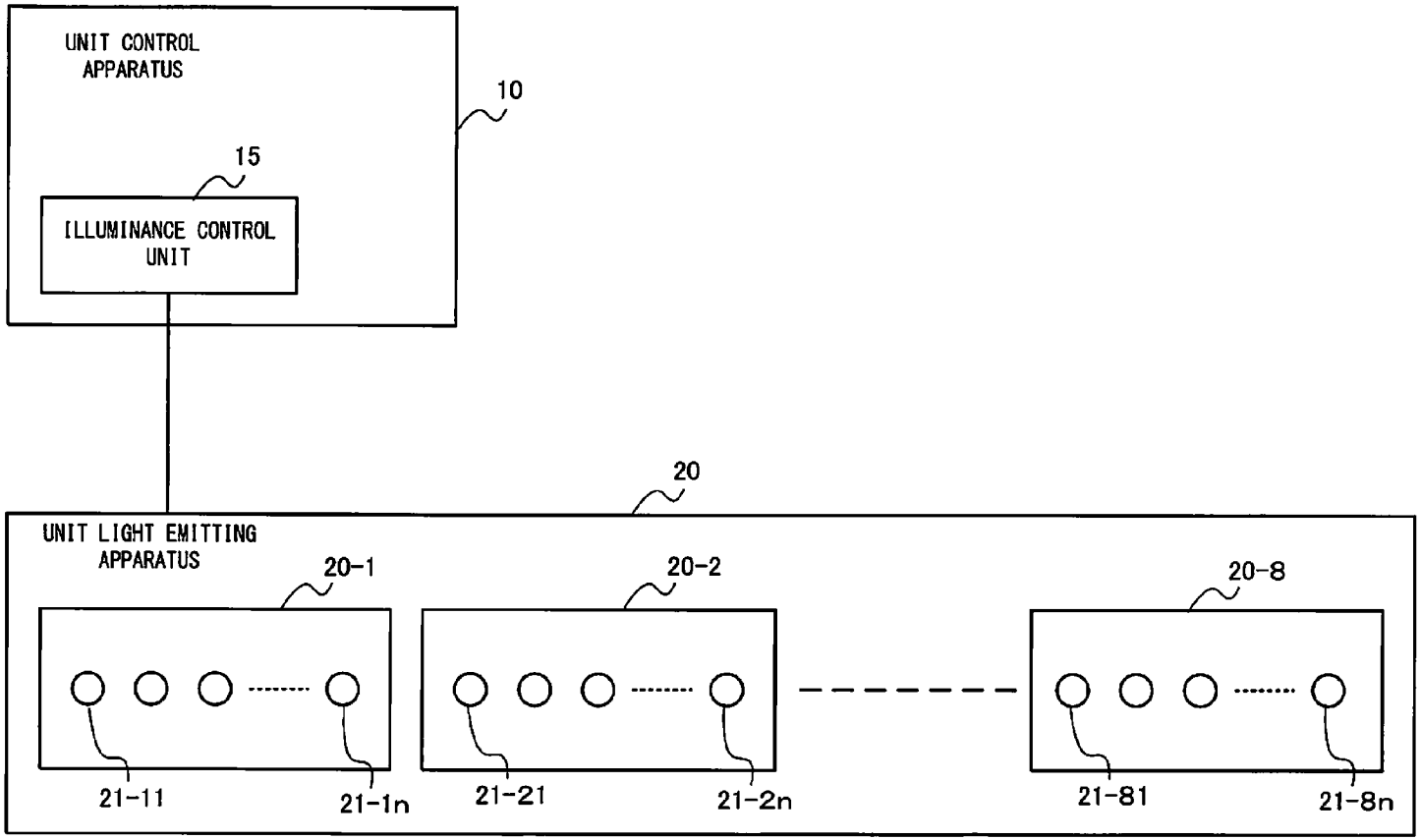

[FIG. 4]
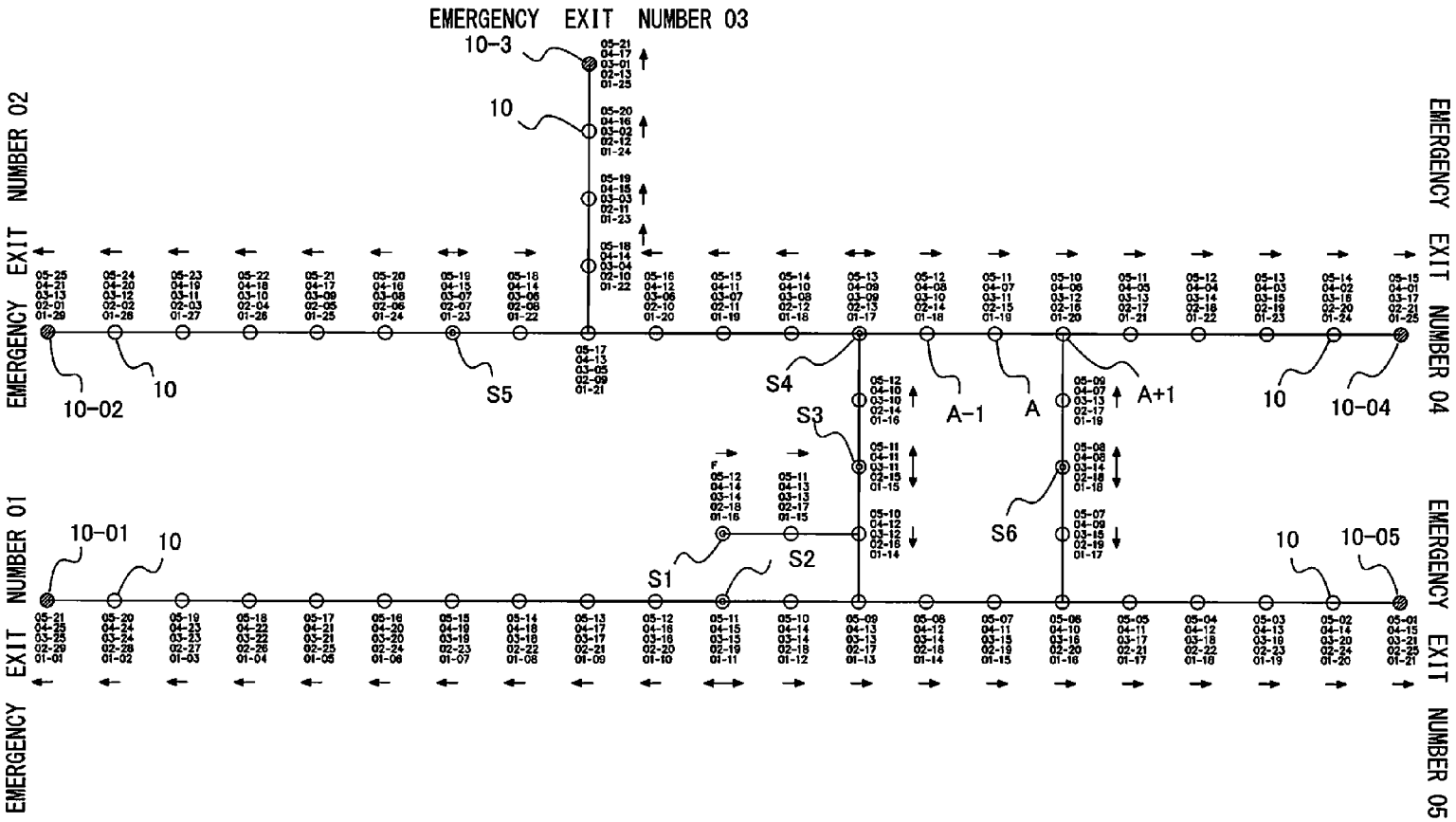

[FIG. 5]
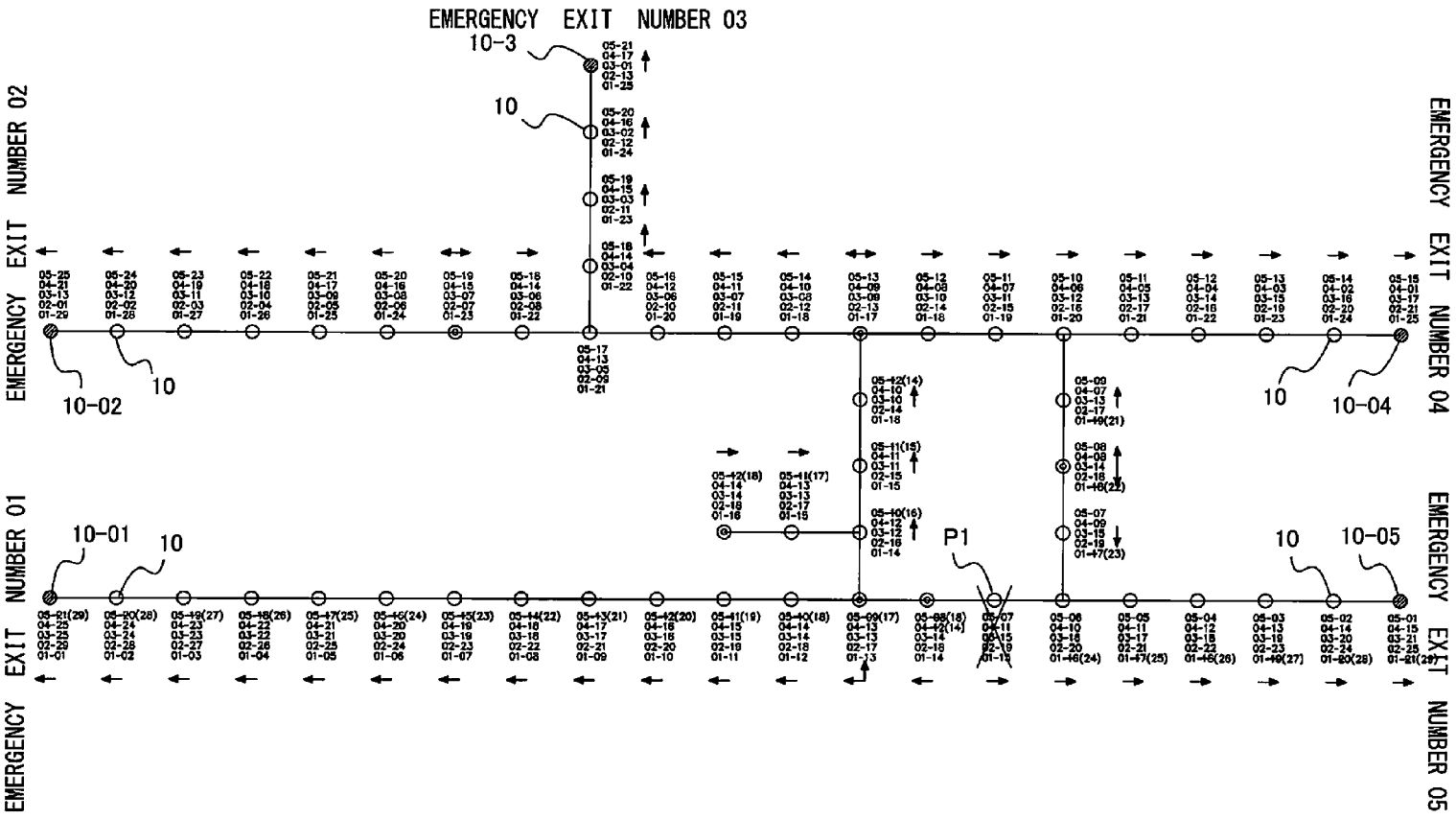

[FIG. 6]
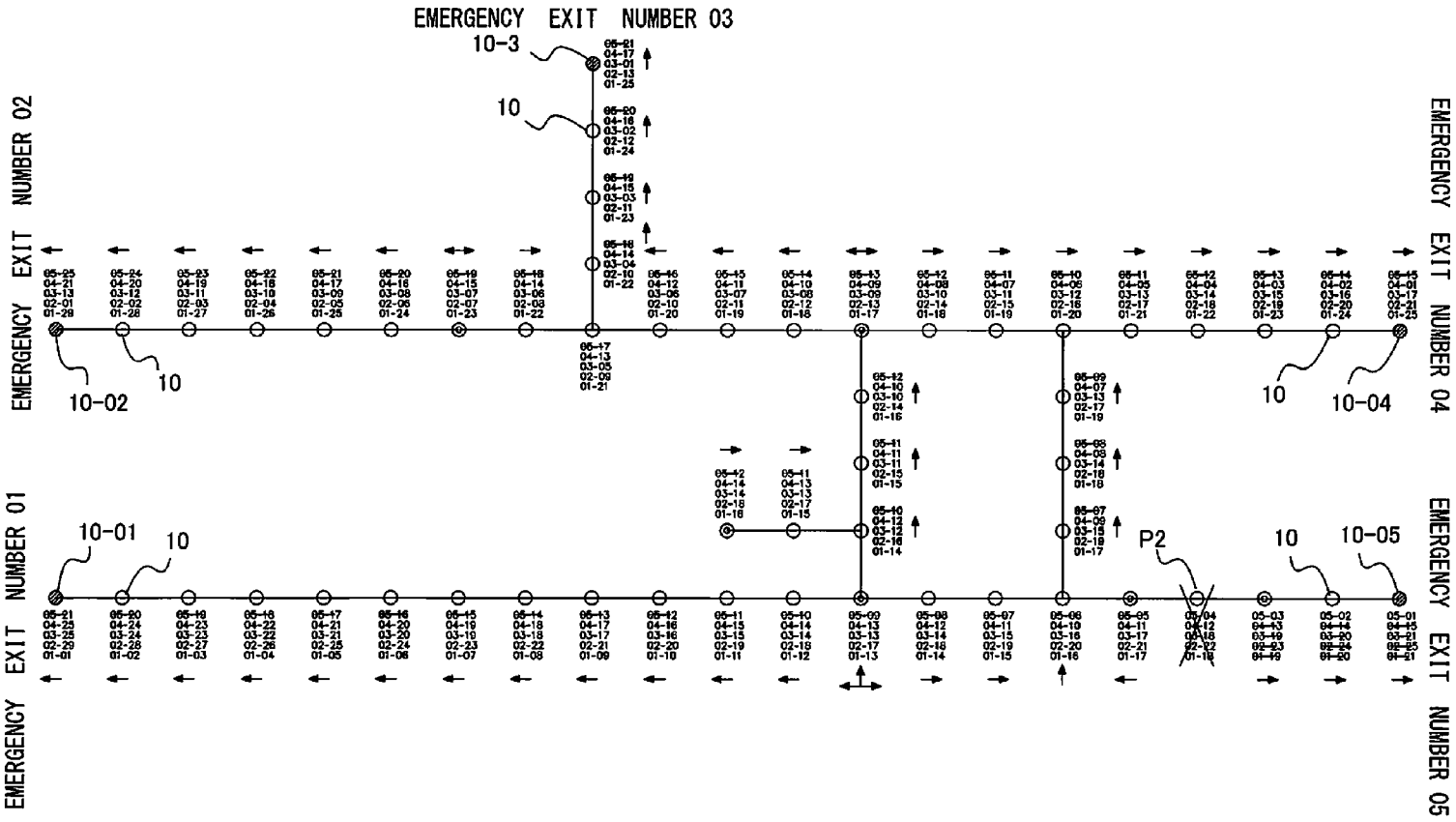

[FIG. 7]
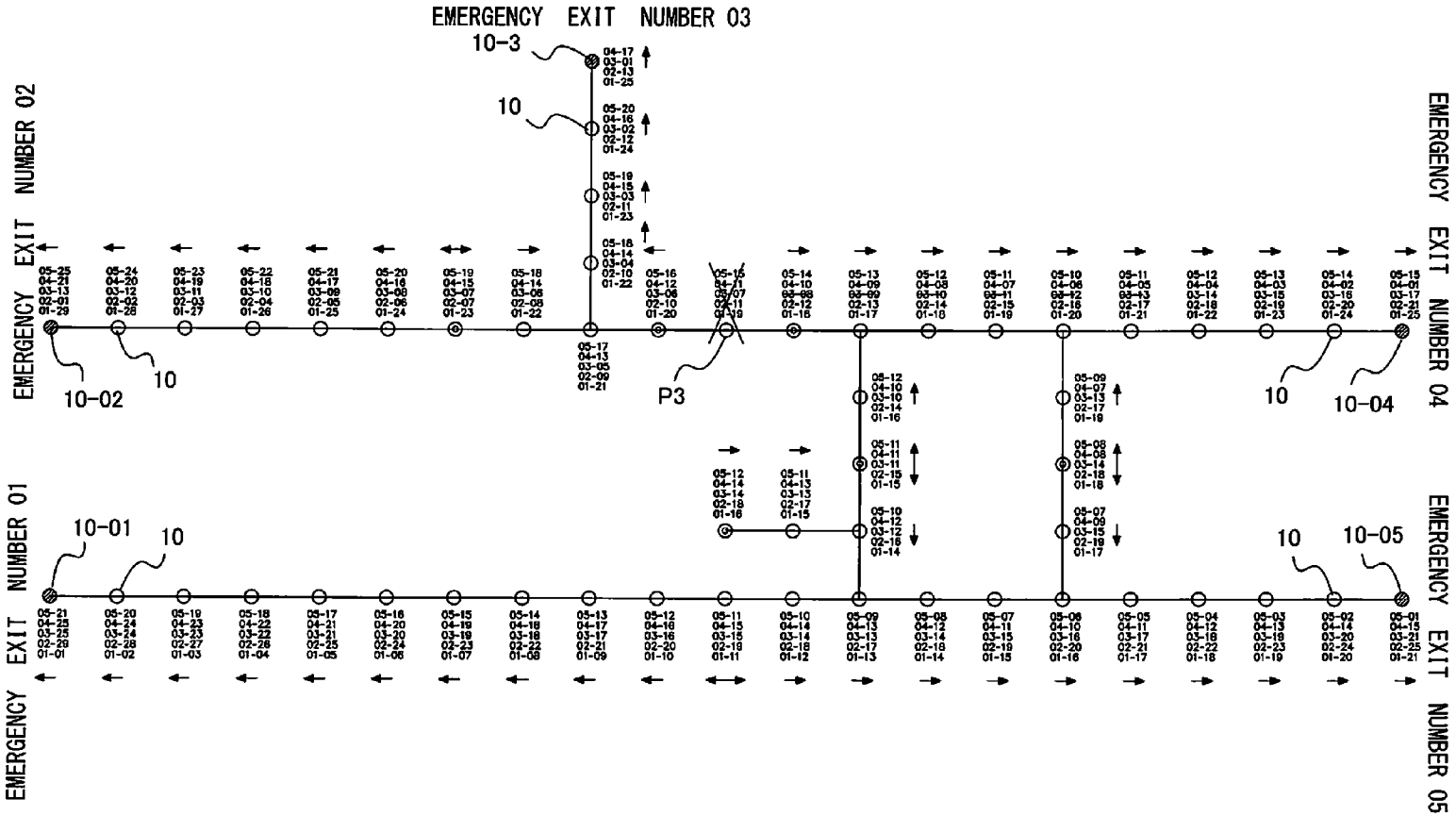

[FIG. 8]
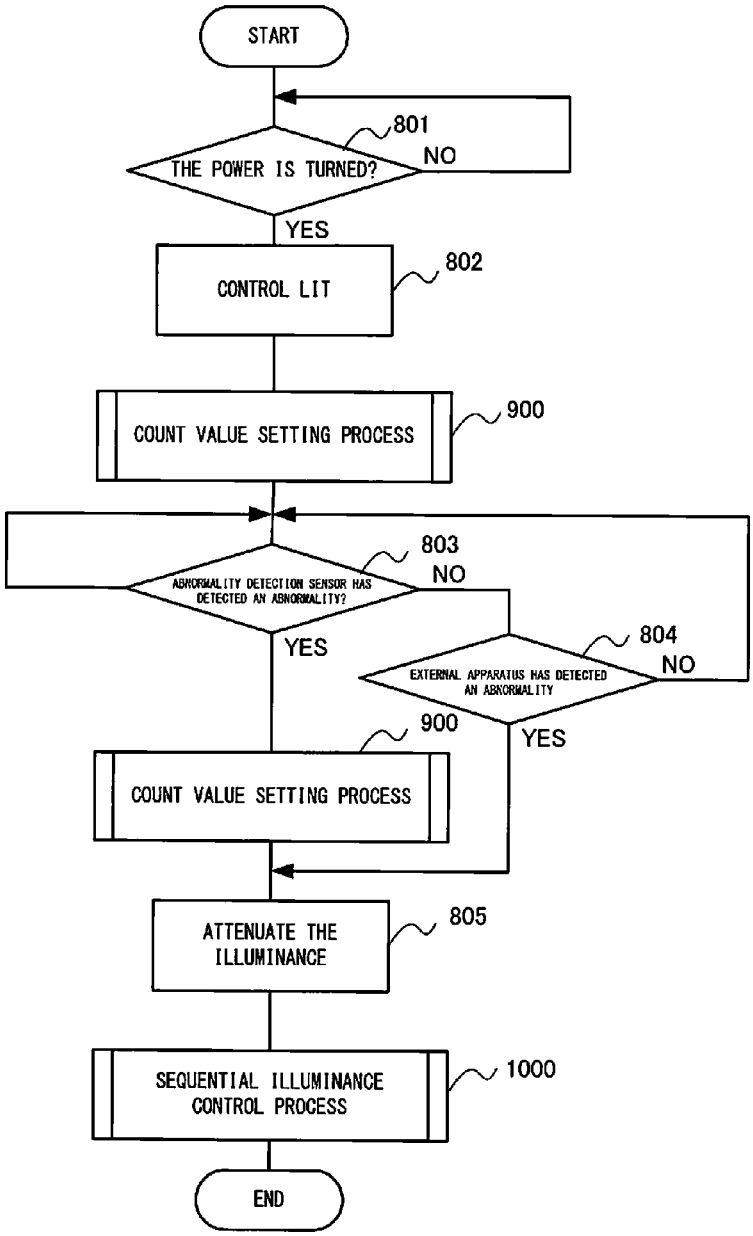

[FIG. 9]
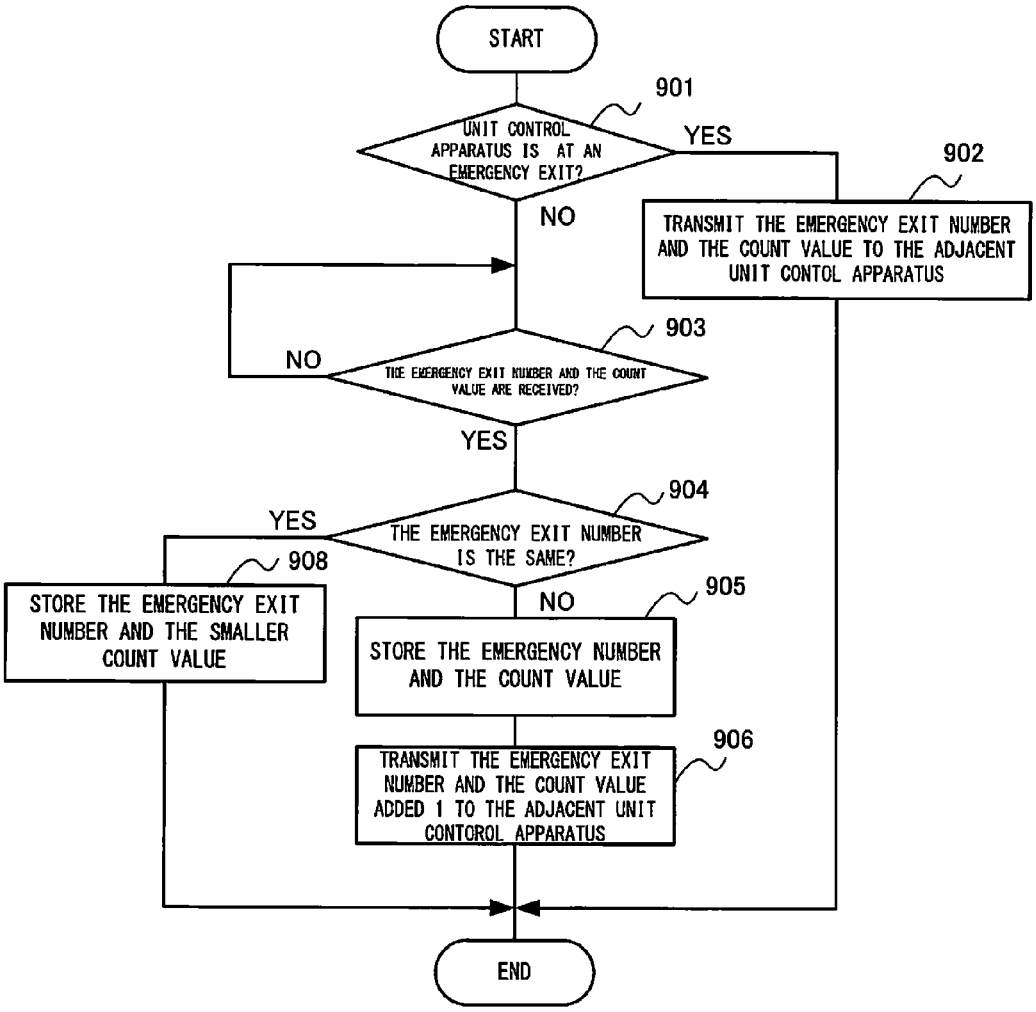

[FIG. 10]
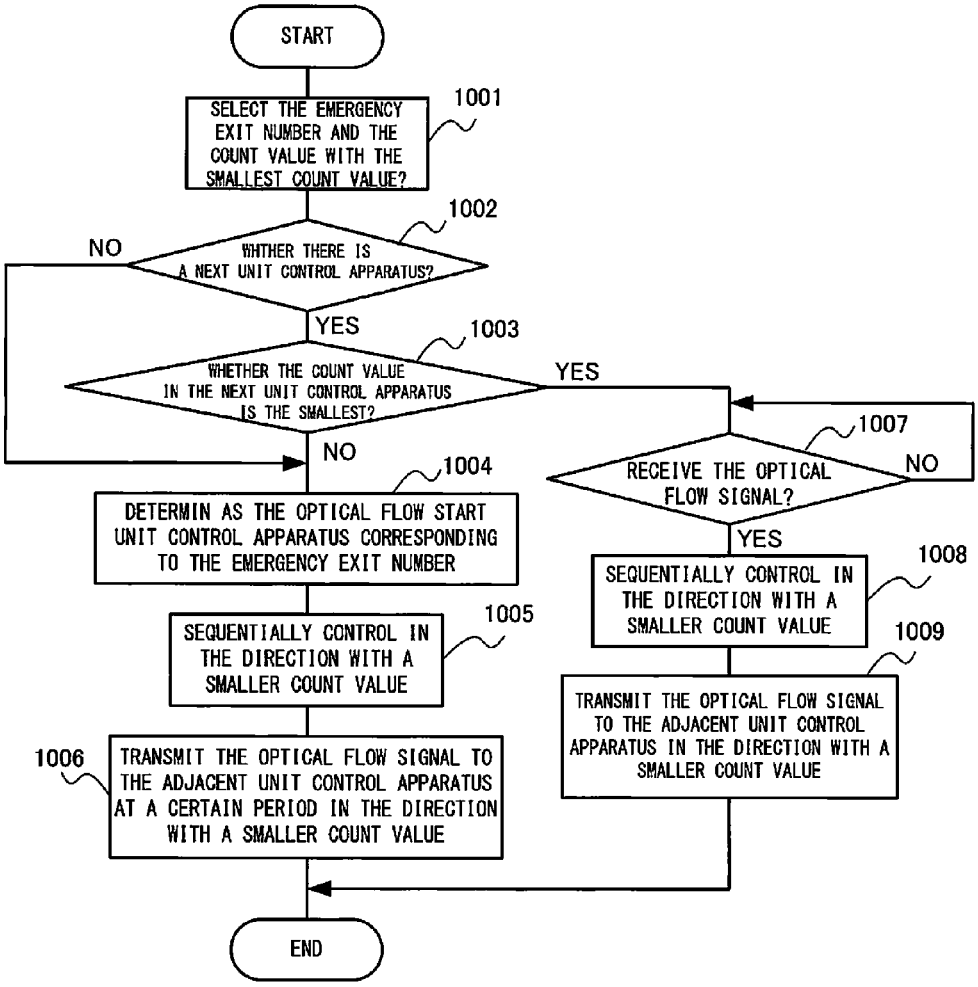

GUIDANCE SYSTEM

This application is a 371 application of PCT/JP2014/081355 filed Nov. 27, 2014, which claims priority to the Japanese application 2013-256217 filed Dec. 11, 2013.

TECHNICAL FIELD

The present invention relates to a guidance system, and particularly, to a guidance system that can quickly guide a person to be guided along a guidance route without a feeling of anxiety.

BACKGROUND ART

Conventionally, an example of a guide system that guides a person to be guided in case of fire or the like as disclosed in Patent Literature 1, has been known.

A guide lamp lighting guiding sound generation apparatus is described in Patent Literature 1, in which guide lamps 1, 2, 3, . . . and speakers 11, 12, 13, . . . are installed at predetermined intervals up to an evacuation door 100 of an evacuation passage of a building, and when a contact point of a fire alarm apparatus 20 is turned on in case of fire, the guide lamps 1, 2, 3, . . . installed up to the evacuation door 100 are sequentially and repeatedly lit at the contact point for a predetermined time toward the evacuation door 100, and the speakers 11, 12, 13, . . . installed up to the evacuation door 100 sequentially and repeatedly send out guiding sound for a predetermined time toward the evacuation door 100.

CITATION LIST

Patent Literature

Patent Literature 1: Japanese Patent Laid-Open No. 5-135286

SUMMARY OF INVENTION

Technical Problem

However, the guide lamp lighting guiding sound generation apparatus disclosed in Patent Literature 1 may increase the feeling of anxiety of the person to be guided due to the blinking of the guide lamps, the intermittent generation of the guiding sound, and the like, and therefore, there is a problem that the person to be guided cannot be quickly guided along the guidance route without a feeling of anxiety.

Consequently, an object of the present invention is to provide a guidance system that can quickly guide a person to be guided along a guidance route without a feeling of anxiety.

Solution to Problem

In order to achieve the above-described object, a guidance system as an invention of claim 1 comprising: a plurality of light emitting apparatuses arranged along a passage; and a control apparatus that individually controls illuminance of the plurality of light emitting apparatuses, wherein the control apparatus comprises guidance control means for sequentially controlling the illuminance of the light emitting apparatuses regarding guidance of the plurality of light emitting apparatuses to make the illuminance different from the illuminance of another adjacent light emitting apparatus, at the guidance, to generate an optical flow toward a desired guidance direction.

An invention of claim 2 is, in the invention of claim 1, the control apparatus comprises normal time control means for controlling the illuminance of the plurality of light emitting apparatuses at a certain illuminance at normal times, and the guidance control means changes the certain illuminance to another illuminance different from the certain illuminance at the guidance to sequentially control the illuminance of the light emitting apparatuses regarding the guidance of the plurality of light emitting apparatuses based on the changed illuminance to make the illuminance different from the illuminance of another adjacent light emitting apparatus.

An invention of claim 3 is, in the invention of claim 2, the guidance control means changes the certain illuminance to another illuminance lower than the certain illuminance, and based on the changed illuminance, sequentially controls the illuminance of the light emitting apparatuses regarding the guidance of the plurality of light emitting apparatuses to an illuminance higher than the changed illuminance.

An invention of claim 4 is, in the invention of claim 2, the guidance control means changes the certain illuminance to another illuminance higher than the certain illuminance, and based on the changed illuminance, sequentially controls the illuminance of the light emitting apparatuses regarding the guidance of the plurality of light emitting apparatuses to an illuminance lower than the changed illuminance.

An invention of claim 5 is, in any one of the inventions of claims 1 to 4, the light emitting apparatus comprises a plurality of light emitting elements arranged in a line on a floor face or a side face of the passage.

An invention of claim 6 is, in any one of the inventions of claims 1 to 5, the plurality of light emitting apparatuses comprise a plurality of unit light emitting apparatuses including a predetermined number of light emitting apparatuses, the control apparatus comprises a plurality of unit control apparatuses provided to correspond to the unit light emitting apparatuses, and the unit control apparatuses comprise: a plurality of abnormality detection sensors that detect abnormalities at arrangement parts of the unit control apparatuses; count value setting means for setting and storing count values of the plurality of unit control apparatuses along routes toward emergency exits in association with identification information of the emergency exits at application of power and setting, and storing count values of the plurality of unit control apparatuses along the routes toward the emergency exits avoiding an abnormality occurrence part of the abnormality detection sensor in association with the identification information of the emergency exits at detection of abnormality by the abnormality detection sensor; and illuminance control means for controlling the plurality of light emitting apparatuses of the plurality of unit light emitting apparatuses to continuously light at a certain illuminance when there is no abnormality, and sequentially controlling the illuminance of each light emitting apparatus regarding the guidance of the plurality of light emitting apparatuses of the unit light emitting apparatuses to make the illuminance different from the illuminance of another adjacent light emitting apparatus based on the count values of the unit control apparatuses set and stored by the count value setting means at an occurrence of abnormality or at detection of abnormality by the abnormality detection sensor, to cause the plurality of light emitting apparatuses to generate an optical flow toward a desired guidance direction.

An invention of claim 7 is, in the invention of claim 6, there are a plurality of emergency exits, and the count value setting means sequentially receives count signals from each emergency exit, and sets and stores count values of the plurality of unit control apparatuses along a shortest route toward the emergency exit in association with the identification information of each emergency exit.

An invention of claim 8 is, in the invention of claim 6 or 7, the illuminance control means determines an optical flow start unit control apparatus based on the emergency exit information and the count values stored in adjacent unit control apparatuses at the occurrence of abnormality or at the detection of abnormality by the abnormality detection sensor, the determined optical flow start unit control apparatus transmits optical flow signals at a predetermined period, and each unit control apparatus that has received the optical flow signals sequentially transmits the optical flow signals to a next unit control apparatus based on the count values to generate the optical flow.

An invention of claim 9 is, in any one of the inventions of claims 6 to 8, the unit control apparatus comprises buffer means for storing the emergency exit information and the count values set and stored in the adjacent unit control apparatuses, and the illuminance control means selects the emergency exit information corresponding to the emergency exit with the smallest count value, and if the illuminance control means determines that the count value of the unit control apparatus corresponding to a direction away from the emergency exit indicated by the selected emergency exit information is not the smallest with reference to the stored information of the buffer means, the illuminance control means determines the unit control apparatus including the illuminance control means that has made the determination as the optical flow start unit control apparatus.

An invention of claim 10 is, in the invention of claim 9, if the illuminance control means determines that there is no unit control apparatus in the direction away from the emergency exit corresponding to the selected emergency exit information with reference to the stored information of the buffer means, the illuminance control means determines the unit control apparatus including the illuminance control means that has made the determination as the optical flow start unit control apparatus.

Advantageous Effect of Invention

The guidance system of the present invention includes: the plurality of light emitting apparatuses arranged along the passage; and the control apparatus that individually controls the illuminance of the plurality of light emitting apparatuses, in which the control apparatus includes the guidance control means for sequentially controlling the illuminance of the light emitting apparatuses regarding the guidance of the plurality of light emitting apparatuses to make the illuminance different from the illuminance of another adjacent light emitting apparatus, at the guidance, to generate the optical flow toward the desired guidance direction. Therefore, the optical flow is created in the state that the light emitting apparatuses are continuously lit, and the optical flow can quickly guide the person to be guided along the guidance route without a feeling of anxiety.

BRIEF DESCRIPTION OF DRAWINGS

FIG. 1 is a block diagram showing an embodiment of a guidance system in which the present invention is applied.

FIG. 2 is a block diagram showing a configuration example of a unit control apparatus shown in FIG. 1.

FIG. 3 is a block diagram showing a configuration example of a unit light emitting apparatus shown in FIG. 1.

FIG. 4 is a diagram describing an operation of the guidance system shown in FIG. 1.

FIG. 5 is a diagram describing another operation of the guidance system shown in FIG. 1.

FIG. 6 is a diagram describing yet another operation of the guidance system shown in FIG. 1.

FIG. 7 is a diagram describing yet another operation of the guidance system shown in FIG. 1.

FIG. 8 is a flow chart describing an example of operation of the guidance system shown in FIG. 1.

FIG. 9 is a flow chart describing detailed operation of a count value setting process shown in FIG. 8.

FIG. 10 is a flow chart describing detailed operation of a sequential illuminance control process shown in FIG. 8.

DESCRIPTION OF EMBODIMENT

Hereinafter, an embodiment of a guidance system according to the present invention will be described in detail with reference to the attached drawings.

FIG. 1 is a block diagram showing an embodiment of a guidance system in which the present invention is applied.

The guidance system shown in FIG. 1 can be applied to, for example, large-scale stores, hospitals, theaters, various facilities, and the like. The guidance system shown in FIG. 1 includes: a plurality of unit control apparatuses 10, 10-01, 10-02, 10-03, 10-04, and 10-05; and a plurality of unit light emitting apparatuses 20 in which the illuminance is controlled by the unit control apparatuses 10, 10-01, 10-02, 10-03, 10-04, and 10-05.

Here, the unit control apparatus 10-01 of the plurality of unit control apparatuses 10, 10-01, 10-02, 10-03, 10-04, and 10-05 is arranged at an emergency exit provided with an emergency exit number 01, the unit control apparatus 10-02 is arranged at an emergency exit provided with an emergency exit number 02, the unit control apparatus 10-03 is arranged at an emergency exit provided with an emergency exit number 03, the unit control apparatus 10-04 is arranged at an emergency exit provided with an emergency exit number 04, and the unit control apparatus 10-05 is arranged at an emergency exit provided with an emergency exit number 05.

Further, the other unit control apparatuses 10 are arranged between the unit control apparatuses 10-01, 10-02, 10-03, 10-04, and 10-05 along passages of these various facilities or the like.

The unit light emitting apparatuses 20 are arranged to correspond to the unit control apparatuses 10, 10-01, 10-02, 10-03, 10-04, and 10-05, each unit light emitting apparatus 20 including, for example, eight light emitting apparatuses 20-1 to 20-8 as shown in FIG. 3, and these eight light emitting apparatuses 20-1 to 20-8 include a plurality of light emitting elements 21-11 to 1*n*, 21-21 to 2*n*, 21-31 to 3*n*, 21-41 to 4*n*, 21-51 to 5*n*, 21-61 to 6*n*, 21-71 to 7*n*, and 21-81 to 8*n* arranged in a line, respectively.

The light emitting elements 21-11 to 1*n*, 21-21 to 2*n*, 21-31 to 3*n*, 21-41 to 4*n*, 21-51 to 5*n*, 21-61 to 6*n*, 21-71 to 7*n*, and 21-84 to 8*n* are arranged, for example, in a line along a floor face, a side face, or a handrail attached to the side face of the passage of various facilities or the like.

Note that 10, 10-01, 10-02, 10-03, 10-04, and 10-05 are mounted on the same substrate and have the same configuration.

FIG. 2 is a block diagram showing a configuration example of the unit control apparatus 10 shown in FIG. 1.

In FIG. 2, the unit control apparatus 10 includes: an emergency exit number count value storage unit 11 that stores count values in association with the emergency exit numbers in a count value setting process described in detail later; an emergency exit number count value buffer unit 12 that stores the emergency exit number count values stored in the emergency exit number count value storage units 11 of adjacent unit control apparatuses 10; an emergency exit number setting unit 13 in which the emergency exit number of the unit control apparatus 10 arranged at the emergency exit is set; an optical flow start unit control apparatus setting unit 14 that sets an optical flow start unit control apparatus determined in a sequential illuminance control process described in detail later; an illuminance control unit 15 that controls the illuminance of the light emitting elements 21-11 to 21-1*n*, 21-21 to 21-2*n*, 21-31 to 21-3*n*, 21-41 to 21-4*n*, 21-51 to 21-5*n*, 21-61 to 21-6*n*, 21-71 to 21-7*n*, and 21-81 to 21-8*n* provided on the plurality of light emitting apparatuses 20-1 to 20-8 of the unit light emitting apparatus 20; an abnormality detection sensor 16 that detects an abnormality at the arrangement position of the unit control apparatus 10; and a control unit 17 that administers and controls the entire unit control apparatus 10.

Here, the abnormality detection sensor 16 can include one of a temperature detection sensor and a smoke detection sensor or a combination of these.

Further, as described in detail later, the control unit 10 includes count value setting means for executing a count value setting process of setting and storing, in the emergency exit number count value storage unit 11, the count values of a plurality of unit control apparatuses 10 along the routes toward the emergency exits in association with the numbers (identification information) of the emergency exits at the application of power to the unit control apparatus 10, and when the abnormality detection sensor 16 of one of the plurality of unit control apparatuses 10 detects an abnormality, setting and storing, in the emergency exit number count value storage unit 11, the count values of a plurality of unit control apparatuses 10 along the routes toward the emergency exits in association with the numbers of the emergency exits with avoiding the abnormality occurrence part by the abnormality detection sensor 16.

Further, as described in detail later, the control unit 17 controls, by the illuminance control unit 15, the illuminance of the light emitting elements 21-11 to 21-1*n*, 21-21 to 21-2*n*, 21-31 to 21-3*n*, 21-41 to 21-4*n*, 21-51 to 21-5*n*, 21-61 to 21-6*n*, 21-71 to 21-7*n*, and 21-81 to 21-8*n* of the plurality of light emitting apparatuses 20-1 to 20-8 of the plurality of unit display apparatuses 20 at a certain illuminance when there is no abnormality (normal time control means).

However, at detection of abnormality by an external abnormality detection apparatus or at detection of abnormality by the abnormality detection sensor 16 of each unit control apparatus 10, the illuminance of all of the light emitting elements 21-11 to 21-1*n*, 21-21 to 21-2*n*, 21-31 to 21-3*n*, 21-41 to 21-4*n*, 21-51 to 21-5*n*, 21-61 to 21-6*n*, 21-71 to 21-7*n*, 21-81 to 21-8*n* of the plurality of light emitting apparatuses 20-1 to 20-8 are changed to a predetermined illuminance, and then the illuminance control unit 15 sequentially controls the illuminance of the light emitting elements of the light emitting apparatuses 20-1 to 20-8 regarding the guidance based on the count values set and stored in the emergency exit number count value storage unit 11 in the count value setting process so that the illuminance becomes different from the illuminance of the other light emitting elements to thereby generate an optical flow toward a desired guidance direction to guide the person to be guided to the emergency exit (guidance control means).

The control by the guidance control means is performed by, for example, attenuating the illuminance of all of the light emitting elements 21-11 to 21-1*n*, 21-21 to 21-2*n*, 21-31 to 21-3*n*, 21-41 to 21-4*n*, 21-51 to 21-5*n*, 21-61 to 21-6*n*, 21-71 to 21-7*n*, and 21-81 to 21-8*n* of the light emitting apparatuses 20-1 to 20-8 to 30% and then sequentially controlling the illuminance of the light emitting elements 21-11 to 21-1*n*, 21-21 to 21-2*n*, 21-31 to 21-3*n*, 21-41 to 21-4*n*, 21-51 to 21-5*n*, 21-61 to 21-6*n*, 21-71 to 21-7*n*, and 21-81 to 21-8*n* to 100% in this order. In this case, an optical flow from the light emitting apparatus 20-1 to the light emitting apparatus 20-8 at an illuminance of 100% is formed.

Further, after the illuminance of all of the light emitting elements 21-11 to 21-1*n*, 21-21 to 21-2*n*, 21-31 to 21-3*n*, 21-41 to 21-4*n*, 21-51 to 21-5*n*, 21-61 to 21-6*n*, 21-71 to 21-7*n*, and 21-81 to 21-8*n* of the light emitting apparatuses 20-1 to 20-8 is attenuated to 30%, the illuminance of the light emitting elements 21-81 to 21-8*n*, 21-71 to 21-7*n*, 21-61 to 21-6*n*, 21-51 to 21-5*n*, 21-41 to 21-4*n*, 21-31 to 21-3*n*, 21-21 to 21-2*n*, and 21-11 to 21-1*n* can be sequentially controlled to 100% in this order to form an optical flow from the light emitting apparatus 20-8 to the light emitting apparatus 20-1 at an illuminance of 100%.

Here, the period of the control of the illuminance of the light emitting elements 21-11 to 21-1*n*, 21-21 to 21-2*n*, 21-31 to 21-3*n*, 21-41 to 21-4*n*, 21-51 to 21-5*n*, 21-61 to 21-6*n*, 21-71 to 21-7*n*, and 21-81 to 21-8*n* can be arbitrarily set.

Further, the illuminance at the attenuation and the illuminance at the sequential control of the light emitting elements 21-11 to 21-1*n*, 21-21 to 21-2*n*, 21-31 to 21-3*n*, 21-41 to 21-4*n*, 21-51 to 21-5*n*, 21-61 to 21-6*n*, 21-71 to 21-7*n*, 21-81 to 21-8*n* can also be arbitrarily set.

Note that although the illuminance of the light emitting elements 21-11 to 21-1*n*, 21-21 to 21-2*n*, 21-31 to 21-3*n*, 21-41 to 21-4*n*, 21-51 to 21-5*n*, 21-61 to 21-6*n*, 21-71 to 21-7*n*, and 21-81 to 21-8*n* is sequentially controlled to 100% after attenuating the illuminance of all of the light emitting elements 21-11 to 21-1*n*, 21-21 to 21-2*n*, 21-31 to 21-3*n*, 21-41 to 21-4*n*, 21-51 to 21-5*n*, 21-61 to 21-6*n*, 21-71 to 21-7*n*, and 21-81 to 21-8*n* to 30% in the above description, the optical flow from the light emitting apparatus 20-1 to the light emitting apparatus 20-8 can also be formed by sequentially controlling the illuminance of the light emitting elements 21-11 to 21-1*n*, 21-21 to 21-2*n*, 21-31 to 21-3*n*, 21-41 to 21-4*n*, 21-51 to 21-5*n*, 21-61 to 21-6*n*, 21-71 to 21-7*n*, and 21-81 to 21-8*n* to, for example, 30% after increasing the illuminance of all of the light emitting elements 21-11 to 21-1*n*, 21-21 to 21-2*n*, 21-31 to 21-3*n*, 21-41 to 21-4*n*, 21-51 to 21-5*n*, 21-61 to 21-6*n*, 21-71 to 21-7*n*, 21-81 to 21-8*n* from 80% to 100%, for example.

In this case, the optical flow can also be in the opposite direction as described above, and further, the period of the control of the illuminance, the illuminance at the increase, and the illuminance at the sequential control of the light emitting elements 21-11 to 21-1*n*, 21-21 to 21-2*n*, 21-31 to 21-3*n*, 21-41 to 21-4*n*, 21-51 to 21-5*n*, 21-61 to 21-6*n*, 21-71 to 21-7*n*, and 21-81 to 21-8*n* can also be arbitrarily set.

Illuminance control means of the control unit 17 controls the control by the normal time control means and the control of the illuminance of the light emitting elements 21-11 to 21-1*n*, 21-21 to 21-2*n*, 21-31 to 21-3*n*, 21-41 to 21-4*n*, 21-51 to 21-5*n*, 21-61 to 21-6*n*, 21-71 to 21-7*n*, and 21-81 to 21-8*n* by the guidance control means.

Further, the unit control apparatuses 10, 10-01, 10-02, 10-03, 10-04, and 10-05 are mutually connected by communication lines, and through the mutual communication, the optical flow between the unit control apparatuses 10, 10-01, 10-02, 10-03, 10-04, and 10-05 smoothly flows.

FIG. 3 is a block diagram showing a configuration example of the unit light emitting apparatus 20 shown in FIG. 1.

As described, the unit light emitting apparatus 20 includes, for example, eight light emitting apparatuses 20-1 to 20-8, the light emitting apparatuses 20-1 to 20-8 including a plurality of light emitting elements 21-11 to 21-1*n*, 21-21 to 21-2*n*, 21-31 to 21-3*n*, 21-41 to 21-4*n*, 21-51 to 21-5*n*, 21-61 to 21-6*n*, 21-71 to 21-7*n*, and 21-81 to 21-8*n* arranged in a line, respectively, and the illuminance of the plurality of light emitting elements 21-11 to 21-1*n*, 21-21 to 21-2*n*, 21-31 to 21-3*n*, 21-41 to 21-4*n*, 21-51 to 21-5*n*, 21-61 to 21-6*n*, 21-71 to 21-7*n*, and 21-81 to 21-8*n* is controlled by the control of the illuminance control unit 15 of the unit control apparatus 10.

Next, operation of the guidance system according to the present invention will be described in detail with reference to specific examples shown in FIGS. 4 to 7 and flow charts shown in FIGS. 8 and 9.

In FIG. 4, at the application of power to the evacuation guidance system, the count value setting means of the control unit 17 of each unit control apparatus 10 executes a count value setting process of setting and storing the emergency exit numbers and the count values in the emergency exit number count value storage unit 11.

More specifically, when power is applied to the evacuation guidance system, the unit control apparatus 10-01 arranged at the emergency exit provided with the emergency exit number 01, the unit control apparatus 10-02 arranged at the emergency exit provided with the emergency exit number 02, the unit control apparatus 10-03 arranged at the emergency exit provided with the emergency exit number 03, the unit control apparatus 10-04 arranged at the emergency exit provided with the emergency exit number 04, and the unit control apparatus 10-05 arranged at the emergency exit provided with the emergency exit number 05 transmit a count value "02", which is obtained by adding "1" to a count value "01" corresponding to the emergency exit numbers, to the adjacent unit control apparatuses 10 along with the emergency exit numbers.

The adjacent unit control apparatuses 10 that have received the emergency exit numbers and the count value "02" store the count value "02" in the emergency exit number count value storage units 11 in association with the emergency exit numbers and transmit a count value "03", which is obtained by adding "1" to the count value "02", to the next adjacent unit control apparatuses 10 along with the emergency exit numbers.

Similarly, the adjacent unit control apparatuses 10 that have received the emergency exit numbers and the count value "03" store the count value "03" in the emergency exit number count value storage units 11 in association with the emergency exit numbers and transmit a count value "04", which is obtained by adding "1" to the count value "03", to the next adjacent unit control apparatuses 10 along with the emergency exit numbers to repeat the operation.

In the operation, if a unit control apparatus 10 receives count values of the same emergency exit number, the smaller count value is left in the emergency exit number count value storage unit 11, the larger count value is discarded, and the count value obtained by adding "1" to the larger count value is not transmitted to the adjacent unit control apparatuses 10.

For example, a unit control apparatus A of FIG. 4 receives a count value "19" from a unit control apparatus A-1 and receives a count value "21" from a unit control apparatus A+1 regarding the emergency exit number "01". Since the count value "19" is smaller than the count value "21", the unit control apparatus A leaves the count value "19", discards the count value "21", and does not transmit the count value "22" to the unit control apparatus A+1.

In this way, the emergency exit number count value storage unit 11 of each unit control apparatus 10 stores, as a count value, the smallest number of unit control apparatuses 10 up to the emergency exit corresponding to each emergency exit number, in association with each emergency exit number.

Next, the unit control apparatuses 10 determine optical flow start unit control apparatuses 10 that are starts of optical flows for guiding the person to be guided to the emergency exits, based on the emergency exit number count values stored in the emergency exit number count value storage units 11 and the emergency exit number count values of the adjacent unit control apparatuses 10 stored in the emergency exit number count value buffer units 12.

The optical flow start unit control apparatuses 10 are determined as follows.

1) The emergency exit number with the smallest count value is selected in each unit control apparatus 10.

2) If there is no adjacent unit control apparatus 10 with a larger count value corresponding to the selected emergency exit number, the unit control apparatus 10 is determined as the optical flow start unit control apparatus 10 toward the emergency exit of the selected emergency exit number.

3) If there is an adjacent unit control apparatus 10 with a larger count value corresponding to the selected emergency exit number, and the count value corresponding to the selected emergency exit number of the adjacent unit control apparatus 10 with the larger count value is not the smallest compared to the count values corresponding to the other emergency exit numbers, the unit control apparatus 10 is determined as the optical flow start unit control apparatus 10 toward the emergency exit of the selected emergency exit number.

In FIG. 4, the unit control apparatuses indicated by double circles denote the unit control apparatuses determined as the optical flow start unit control apparatuses (the same applies to FIGS. 5, 6, and 7).

For example, in a unit control apparatus S1 of FIG. 4, the emergency exit number "05" with a count value "12" is selected as the emergency exit number with the smallest count value. There is no adjacent unit control apparatus in the direction with a larger count value of the emergency exit number "05", and the unit control apparatus S1 is determined as the optical flow start unit control apparatus toward the emergency exit with the emergency exit number "05".

Further, in a unit control apparatus S2 of FIG. 4, the emergency exit numbers "01" and "05" with a count value "11" are selected as the emergency exit numbers with the smallest count value. The count value in the adjacent unit control apparatus in the direction with a larger count value of the selected emergency exit number "01" is "12", which is not the smallest compared to the count values corresponding to the other emergency exit numbers. Therefore, the unit control apparatus S2 is determined as the optical flow start unit control apparatus toward the emergency exit with the emergency exit number "01". Further, the count value of the adjacent unit control apparatus in the direction with a larger count value of the selected emergency exit number "05" is "12", which is not the smallest compared to the count values corresponding to the other emergency exit numbers. Therefore, the unit control apparatus S2 is also determined as the optical flow start unit control apparatus toward the emergency exit with the emergency exit number "05".

Similarly, in a unit control apparatus S3 of FIG. 4, the emergency exit numbers "03", "04", and "05" with a count value "11" are selected as the emergency exit numbers with the smallest count value. The count value in the adjacent unit control apparatus in the direction with a larger count value of the selected emergency exit number "03" is "12", which is not the smallest compared to the count values corresponding to the other emergency exit numbers. Therefore, the unit control apparatus S3 is determined as the optical flow start unit control apparatus toward the emergency exit with the emergency exit number "03". Further, the count value in the adjacent unit control apparatus in the direction with a larger count value of the selected emergency exit number "04" is "12", which is not the smallest compared to the count values corresponding to the other emergency exit numbers. Therefore, the unit control apparatus S3 is also determined as the optical flow start unit control apparatus toward the emergency exit with the emergency exit number "04". Further, the count value in the adjacent unit control apparatus in the direction with a larger count value of the selected emergency exit number "05" is "12", which is not the smallest compared to the count values compared to the other emergency exit numbers. Therefore, the unit control apparatus S3 is also determined as the optical flow start unit control apparatus toward the emergency exit with the emergency exit number "05".

Similarly, in a unit control apparatus S4 of FIG. 4, the emergency exit numbers "02" and "05" with a count value "13" are selected as the emergency exit numbers with the smallest count value. The count value in the adjacent unit control apparatus in the direction with a larger count value of the selected emergency exit number "02" is "14", which is not the smallest compared to the count values corresponding to the other emergency exit numbers. Therefore, the unit control apparatus S4 is determined as the optical flow start unit control apparatus toward the emergency exit with the emergency exit number "02". Further, the count value in the adjacent unit control apparatus in the direction with a larger count value of the selected emergency exit number "05" is "14", which is not the smallest compared to the count values corresponding to the other emergency exit numbers. Therefore, the unit control apparatus S4 is also determined as the optical flow start unit control apparatus toward the emergency exit with the emergency exit number "05".

Similarly, in a unit control apparatus S5 of FIG. 4, the emergency exit numbers "02" and "03" with a count value "07" are selected as the emergency exit numbers with the smallest count value. The count value in the adjacent unit control apparatus in the direction with a larger count value of the selected emergency exit number "02" is "08", which is not the smallest compared to the count values corresponding to the other emergency exit numbers. Therefore, the unit control apparatus S5 is determined as the optical flow start unit control apparatus toward the emergency exit with the emergency exit number "02". Further, the count value in the adjacent unit control apparatus in the direction with a larger count value of the selected emergency exit number "03" is "08", which is not the smallest compared to the count values corresponding to the other emergency exit numbers. Therefore, the unit control apparatus S5 is also determined as the optical flow start unit control apparatus toward the emergency exit with the emergency exit number "03".

Similarly, in a unit control apparatus S6 of FIG. 4, the emergency exit numbers "04" and "05" with a count value "08" are selected as the emergency exit numbers with the smallest count value. The count value in the adjacent unit control apparatus in the direction with a larger count value of the selected emergency exit number "04" is "09", which is not the smallest compared to the count values corresponding to the other emergency exit numbers. Therefore, the unit control apparatus S6 is determined as the optical flow start unit control apparatus toward the emergency exit with the emergency exit number "04". Further, the count value in the adjacent unit control apparatus in the direction with a larger count value of the selected emergency exit number "05" is "09", which is not the smallest compared to the count values corresponding to the other emergency exit numbers. Therefore, the unit control apparatus S5 is also determined as the optical flow start unit control apparatus toward the emergency exit with the emergency exit number "05".

In this state, if an externally installed abnormality detection apparatus not shown detects an abnormality, the optical flow start unit control apparatuses determined in the process transmit optical flow signals toward the emergency exits at a predetermined period, and the unit control apparatuses 10 sequentially transfer the optical flow signals to the unit control apparatuses 10 adjacent in the directions toward the emergency exits to thereby form optical flows for guiding the person to be guided to the nearest emergency exit. In FIG. 4, arrows described in association with the unit control apparatuses 10 indicate the optical flow directions for guiding the person to be guided to the nearest emergency exit.

More specifically, in the specific example shown in FIG. 4, if the externally installed abnormality detection apparatus not shown does not detect an abnormality, the plurality of light emitting elements 21-11 to 21-1*n*, 21-21 to 21-2*n*, 21-31 to 21-3*n*, 21-41 to 21-4*n*, 21-51 to 21-5*n*, 21-61 to 21-6*n*, 21-71 to 21-7*n*, and 21-81 to 21-8*n* provided on the light emitting apparatuses 20-1 to 20-8 of the unit light emitting apparatuses 20 corresponding to the unit control apparatuses 10 are continuously lit at a certain illuminance. If the externally installed abnormality detection apparatus not shown detects an abnormality, the illuminance of the plurality of light emitting elements 21-11 to 21-1*n*, 21-21 to 21-2*n*, 21-31 to 21-3*n*, 21-41 to 21-4*n*, 21-51 to 21-5*n*, 21-61 to 21-6*n*, 21-71 to 21-7*n*, and 21-81 to 21-8*n* provided on the light emitting apparatuses 20-1 to 20-8 of the unit light emitting apparatuses 20 corresponding to the unit control apparatuses 10 is sequentially controlled to form the optical flows for guiding the person to be guided to the nearest emergency exit.

A specific example shown in FIG. 5 illustrates operation when an abnormality occurs in one of the plurality of unit control apparatuses 10, and the abnormality detection sensor 16 of the unit control apparatus 10 detects the abnormality.

The specific example of FIG. 5 illustrates operation when an abnormality occurs in a unit control apparatus P1 of the plurality of unit control apparatuses 10, and the abnormality detection sensor 16 of the unit control apparatus P1 detects the abnormality.

An abnormality detection signal detected by the abnormality detection sensor 16 of the unit control apparatus P1 is transmitted to the unit control apparatuses 10 arranged at the emergency exits through the unit control apparatuses 10. When the abnormality detection signal is received, the unit control apparatuses 10 arranged at the emergency exits transmit the count value "02", which is obtained by adding "1" to the count value "01" corresponding to the emergency exit numbers, to the adjacent unit control apparatuses 10 along with the emergency exit numbers, and the unit control apparatuses 10 execute again the count value setting process of setting and storing, in the emergency exit number count value storage units 11, the count values of the plurality of unit control apparatuses 10 along the routes toward the emergency exits in association with the numbers (identification information) of the emergency exits.

In this case, the unit control apparatus P1 does not transmit the count values to the adjacent unit control apparatuses 10, and the stored content of the emergency exit number count value storage units 11 of the unit control apparatus 10 is overwritten by count values indicated by parentheses in FIG. 5.

More specifically, in this case, the emergency exit number count value storage unit 11 of each unit control apparatus 10 stores, as the count value, the smallest number of unit control apparatuses 10 up to the emergency exit corresponding to each emergency exit number in association with each emergency exit number, avoiding the unit control apparatus P1 with the abnormality.

Next, the unit control apparatuses 10 determine the optical flow start unit control apparatuses 10 that are starts of optical flows for guiding the person to be guided to the emergency exits based on the emergency exit number count values stored in the emergency exit number count value storage units 11 and the emergency exit number count values of the adjacent unit control apparatuses 10 stored in the emergency exit number count value buffer units 12. The determination method of the optical flow start unit control apparatuses 10 is the same as the method described in FIG. 4.

After the determination of the optical flow start unit control apparatuses 10, the optical flow start unit control apparatuses transmit optical flow signals toward the emergency exits. In this way, the unit control apparatuses 10 sequentially transfer the optical flow signals to the unit control apparatuses 10 adjacent in the directions toward the emergency exits to thereby sequentially control the illuminance of the plurality of light emitting elements 21-11 to 21-1*n*, 21-21 to 21-2*n*, 21-31 to 21-3*n*, 21-41 to 21-4*n*, 21-51 to 21-5*n*, 21-61 to 21-6*n*, 21-71 to 21-7*n*, and 21-81 to 21-8*n* provided on the light emitting apparatuses 20-1 to 20-8 of the unit light emitting apparatuses 20 corresponding to the unit control apparatuses 10 to form optical flows for guiding the person to be guided to the nearest emergency exit. In FIG. 5, arrows described in association with the unit control apparatuses 10 indicate the optical flow directions for guiding the person to be guided to the nearest emergency exit.

More specifically, if the abnormality detection sensors 16 of the unit control apparatuses 10 do not detect an abnormality in the specific example shown in FIG. 5, the plurality of light emitting elements 21-11 to 21-1*n*, 21-21 to 21-2*n*, 21-31 to 21-3*n*, 21-41 to 21-4*n*, 21-51 to 21-5*n*, 21-61 to 21-6*n*, 21-71 to 21-7*n*, and 21-81 to 21-8*n* provided on the light emitting apparatuses 20-1 to 20-8 of the unit light emitting apparatuses 20 corresponding to the unit control apparatuses 10 are continuously lit at a certain illuminance. If the abnormality detection sensor 16 of the unit control apparatus P1 detects an abnormality, the illuminance of the plurality of light emitting elements 21-11 to 21-1*n*, 21-21 to 21-2*n*, 21-31 to 21-3*n*, 21-41 to 21-4*n*, 21-51 to 21-5*n*, 21-61 to 21-6*n*, 21-71 to 21-7*n*, and 21-81 to 21-8*n* provided on the light emitting apparatuses 20-1 to 20-8 of the unit light emitting apparatuses 20 corresponding to the unit control apparatuses 10 is sequentially controlled to avoid the unit control apparatus P1 to form the optical flows for guiding the person to be guided to the nearest emergency exit.

A specific example shown in FIG. 6 illustrates operation when an abnormality occurs in a unit control apparatus P2, and the abnormality detection sensor 16 of the unit control apparatus P2 detects the abnormality. A specific example shown in FIG. 7 illustrates operation when an abnormality occurs in a unit control apparatus P3, and the abnormality detection sensor 16 of the unit control apparatus P3 detects the abnormality. Note that the operation of the specific example shown in FIG. 6 and the operation of the specific example shown in FIG. 7 are the same as the operation of the specific example shown in FIG. 5, except that the positions of the abnormality occurrence unit control apparatuses 10 are different. FIG. 8 is a flow chart describing an example of the operation of the guidance system shown in FIG. 1.

In FIG. 8, whether power of the evacuation guidance system is turned on is first checked in step 801. Here, if the power is not turned on (NO in step 801), the process returns to step 801. If it is determined that the power is turned on in step 801 (YES in step 801), the plurality of light emitting elements 21-11 to 21-1*n*, 21-21 to 21-2*n*, 21-31 to 21-3*n*, 21-41 to 21-4*n*, 21-51 to 21-5*n*, 21-61 to 21-6*n*, 21-71 to 21-7*n*, and 21-81 to 21-8*n* provided on the light emitting apparatuses 20-1 to 20-8 of the unit light emitting apparatuses 20 are continuously lit to operate as night lights (step 802).

Next, a count value setting process is executed (step 900). The count value setting process is a process of setting and storing, in the emergency exit number count value storage unit 11, the count values from the emergency exits of the unit control apparatuses 10 along the routes toward the emergency exits in association with the numbers (identification information) of the emergency exits as described above, and details of the count value setting process will be described in detail later in FIG. 9.

Next, whether the externally installed external apparatus not shown, which checks whether the abnormality detection sensors 16 of the unit control apparatuses 10 have detected an abnormality, has detected an abnormality is checked (step 803). Here, if it is determined that the abnormality detection sensors 16 of the unit control apparatuses 10 have detected an abnormality (YES in step 803), the illuminance of all of the light emitting elements 21-11 to 21-1*n*, 21-21 to 21-2*n*, 21-31 to 21-3*n*, 21-41 to 21-4*n*, 21-51 to 21-5*n*, 21-61 to 21-6*n*, 21-71 to 21-7*n*, and 21-81 to 21-8*n* of the unit light emitting apparatuses 20 corresponding to the unit control apparatuses 10 is attenuated to, for example 30% (step 805).

Then, a sequential illuminance control process of sequentially controlling the illuminance of the light emitting elements 21-11 to 21-1*n*, 21-21 to 21-2*n*, 21-31 to 21-3*n*, 21-41 to 21-4*n*, 21-51 to 21-5*n*, 21-61 to 21-6*n*, 21-71 to 21-7*n*, and 21-81 to 21-8*n* of the unit light emitting apparatuses 20 corresponding to the unit control apparatuses 10 to form the optical flows for guiding the person to be guided to the nearest emergency exit is executed (step 1000). Details of the sequential illuminance control process will be described in detail later in FIG. 10.

Further, if it is determined that the abnormality detection sensors 16 of the unit control apparatuses 10 have not detected an abnormality in step 803 (NO in step 803), whether the externally installed external apparatus not shown has detected an abnormality is checked next (step 804). Here, if it is determined that an abnormality has not been detected (NO in step 804), the process returns to step 803. If it is determined that an abnormality has been detected (YES in step 804), the count value setting process is executed again (step 900). Subsequently, the attenuation process of the light emitting elements is executed (step 804), and the sequential illuminance control process is executed (step 1000).

FIG. 9 is a flow chart describing detailed operation of the count value setting process shown in FIG. 8.

When the count value setting process is executed, whether the unit control apparatus 10 is a unit control apparatus 10 installed at an emergency exit is first checked (step 901). Here, if the unit control apparatus 10 is a unit control apparatus 10 installed at an emergency exit (YES in step 901), the emergency exit number of the emergency exit and the count value "02" are transmitted to the adjacent unit control apparatus 10 (step 902).

If it is determined that the unit control apparatus 10 is not a unit control apparatus 10 installed at an emergency exit in step 901 (NO in step 901), whether the emergency exit number and the count value are received from an adjacent unit control apparatus 10 is checked (step 903). Here, if it is determined that the emergency exit number and the count value are not received (NO in step 903), the process returns to step 903 to wait for the reception of the emergency exit number and the count value. If it is determined that the emergency exit number and the count value are received (YES in step 903), whether the received emergency exit number is the same as an already received emergency exit number is checked next (step 904).

Here, if it is determined that the received emergency exit number is not the same as an already received emergency exit number (NO in step 904), the count value is stored in the emergency exit number count value storage unit 11 in association with the received emergency exit number. Then, "1" is added to the received count value, and the count value is transmitted to an adjacent unit control apparatus 10 (step 906).

Note that if it is determined the received emergency exit number is the same as an already received emergency exit number in step 904 (YES in step 904), the smaller count value is left in the emergency exit number count value storage unit 11 (step 908), and the count value obtained by adding "1" to the larger count value is not transmitted to the next adjacent unit control apparatus 10.

FIG. 10 is a flow chart describing detailed operation of the sequential illuminance control process shown in FIG. 8.

In the sequential illuminance control process shown in FIG. 10, the emergency exit number with the smallest count value is first selected in each unit control apparatus 10 (step 1001). Next, whether there is a next unit control apparatus 10 adjacent next is checked (step 1002). Here, if there is no next unit control apparatus 10 (NO in step 1002), the unit control apparatus 10 is determined as the flow start unit control apparatus corresponding to the emergency exit number (step 1004).

If it is determined next that there is a next unit control apparatus 10 adjacent next in step 1002 (YES in step 1002), the emergency exit number count value buffer unit 12 is referenced to check whether the count value in the next unit control apparatus 10 corresponding to the emergency exit number is the smallest compared to the count values corresponding to the other emergency exit numbers (step 1003). Here, if the count value in the next unit control apparatus 10 is not the smallest (NO in step 1003), the unit control apparatus 10 is determined as the flow start unit control apparatus corresponding to the emergency exit number (step 1004).

Then, the illuminance of the plurality of light emitting elements 21-11 to 21-1*n*, 21-21 to 21-2*n*, 21-31 to 21-3*n*, 21-41 to 21-4*n*, 21-51 to 21-5*n*, 21-61 to 21-6*n*, 21-71 to 21-7*n*, and 21-81 to 21-8*n* provided on the light emitting apparatuses 20-1 to 20-8 corresponding to the unit control apparatus 10 is sequentially controlled in the direction with a smaller count value (step 1005), and the optical flow signal is transmitted to the adjacent unit control apparatus 10 at a certain period in the direction with a smaller count value (step 1006).

Further, if it is determined in step 1003 that the count value in the next unit control apparatus 10 corresponding to the emergency exit number is the smallest compared to the count values corresponding to the other emergency exit numbers (YES in step 1003), whether the optical flow signal is received from the adjacent unit control apparatus 10 is checked because the unit control apparatus 10 is not the flow start unit control apparatus (step 1007). Here, if the optical flow signal is not received (NO in step 1007), the process returns to step 1007 to wait for the reception of the optical flow signal. If it is determined that the optical flow signal is received (YES in step 1007), the illuminance of the plurality of light emitting elements 21-11 to 21-1*n*, 21-21 to 21-2*n*, 21-31 to 21-3*n*, 21-41 to 21-4*n*, 21-51 to 21-5*n*, 21-61 to 21-6*n*, 21-71 to 21-7*n*, and 21-81 to 21-8*n* provided on the light emitting apparatuses 20-1 to 20-8 corresponding to the unit control apparatus 10 is sequentially controlled in the direction with a smaller count value (step 1008). Then, the optical flow signal is transferred to the adjacent unit control apparatus 10 in the direction with a smaller count value (step 1009).

Note that although the unit control apparatus 10 adds "1" to the count value of the unit control apparatus 10 and transmits the count value to the next unit control apparatus 10 in the count value setting process of the embodiment, the count value of the unit control apparatus 10 may be transmitted as it is to the next unit control apparatus 10, and the next unit control apparatus 10 may add "1" to the count value.

Note that the present invention is not limited to the embodiment, and many changes can be made by the ordinary creative activity of a person skilled in the art within the technical concept of the present invention.

For example, although the number of light emitting apparatuses in each unit light emitting apparatus is eight in the description of the embodiment, the number may be a number smaller than eight or may be a number greater than eight. Further, the number of light emitting elements in each light emitting apparatus can also be arbitrarily set. Further, although the numbers of the light emitting apparatuses are the same numbers, the numbers may be different.

Further, for example, the light emitting elements in a light emitting apparatus installed on a passage with a dead end ahead that is not connected to an emergency exit may be lit at a luminance of, for example, 30% at the guidance. This configuration can eliminate the inconvenience that the person to be guided is accidentally strayed into the passage.

INDUSTRIAL APPLICABILITY

The present invention can be used for evacuation and guidance when an abnormality, such as a fire, occurs in a large-scale store, a hospital, an airport, various exhibition halls, or the like. The present invention provides: a plurality of light emitting apparatuses arranged along a passage; and a control apparatus that individually controls illuminance of the plurality of light emitting apparatuses, wherein the control apparatus includes guidance control means for sequentially controlling the illuminance of the light emitting apparatuses regarding guidance of the plurality of light emitting apparatuses to make the illuminance different from the illuminance of another adjacent light emitting apparatus, at the guidance, to generate an optical flow toward a desired guidance direction. A guidance system that can quickly guide a person to be guided along a guidance route without a feeling of anxiety can be provided.

REFERENCE SIGNS LIST

10 Unit control apparatus
11 Emergency exit number count value storage unit
12 Emergency exit number count value buffer unit
13 Emergency exit number setting unit
14 Optical flow start unit control apparatus setting unit
15 Illuminance control unit
16 Abnormality detection sensor
17 Control unit
20 Unit light emitting apparatus
21-1 to 21-8 Light emitting apparatus

The invention claimed is:

1. A guidance system comprising: a plurality of light emitting apparatuses arranged along a passage; a control apparatus that individually controls illuminance of the plurality of light emitting apparatuses; and a plurality of abnormality detection sensors that detect abnormalities at arrangement parts of the light emitting apparatuses, wherein the control apparatus is adapted for setting a guide route so as to avoid an abnormality detected part of the abnormality detection sensor if the abnormality detection sensor detects abnormality and is adapted for sequentially controlling the illuminance of the plurality of light emitting apparatuses regarding guidance of the plurality of light emitting apparatuses to make the illuminance different from the illuminance of another adjacent light emitting apparatus, along the guide route set by the guide route setting means, to generate an optical flow toward the guidance direction of the guide route, wherein the plurality of light emitting apparatuses comprise a plurality of unit light emitting apparatuses including a predetermined number of light emitting apparatuses and the control apparatus comprises a plurality of unit control apparatuses corresponding to the unit light emitting apparatuses and the abnormality detection sensor corresponds to the unit light emitting apparatuses the unit control apparatuses is adapted for storing and setting the smallest count values of the number of the unit control apparatuses on the guide route avoiding the abnormality detected part from each emergency exit in association with the identification information of the emergency exit and is adapted for selecting the identification information in association with the smallest count value in the count values stored on the count value setting means, and determining the unit control apparatus as an optical flow start unit control apparatus toward emergency exit in association with the selected identification information if the count value of the unit control apparatus in the direction away from the emergency exit in association with the selected identification information is determined not the smallest in respect to the count value in association with the other identification information of its own apparatus, wherein the control apparatus sequentially transmits the optical flow signals at a predetermined period to adjacent unit control apparatuses in the direction with a smaller count value in respect to the selected identification information from the optical flow start unit, and each control apparatus that has received the optical flow signals sequentially controls illuminance of the corresponding predetermined light emitting apparatuses to generate the optical flow, and further wherein the unit control apparatuses are adapted for receiving the count values and the identification information indicating the emergency exit from the unit control apparatus adjacent to the emergency exit side, for storing the smaller count value in association with the identification information to set and discharging the larger count value if different count values in the same identification information are received, and for transmitting the stored count value and the identification information to the unit control apparatus adjacent to the side away from the emergency exit.

2. The guidance system according to claim 1, wherein the control apparatus changes the certain illuminance to another illuminance lower than the certain illuminance, and based on the changed illuminance, sequentially controls the illuminance of the light emitting apparatuses regarding the guidance of the plurality of light emitting apparatuses to an illuminance higher than the changed illuminance.

3. The guidance system according to claim 2, wherein the light emitting apparatus comprises a plurality of light emitting elements arranged in a line on a floor face or a side face of the passage.

4. The guidance system according to claim 2, wherein, at the guidance by the control apparatus, the light emitting elements in the light emitting apparatus installed on the passage with a dead end head are lit at a lower luminance than normal luminance.

5. The guidance system according to claim 1, wherein the control apparatus changes the certain illuminance to another illuminance higher than the certain illuminance, and based on the changed illuminance, sequentially controls the illuminance of the light emitting apparatuses regarding the guidance of the plurality of light emitting apparatuses to an illuminance lower than the changed illuminance.

6. The guidance system according to claim 5, wherein the light emitting apparatus comprises a plurality of light emitting elements arranged in a line on a floor face or a side face of the passage.

7. The guidance system according to claim 5, wherein, at the guidance by the control apparatus, the light emitting elements in the light emitting apparatus installed on the passage with a dead end head are lit at a lower luminance than normal luminance.

8. The guidance system according to claim 1, wherein the light emitting apparatus comprises a plurality of light emitting elements arranged in a line on a floor face or a side face of the passage.

9. The guidance system according to claim 8, wherein, at the guidance by the control apparatus, the light emitting elements in the light emitting apparatus installed on the passage with a dead end head are lit at a lower luminance than normal luminance.

10. The guidance system according to claim 1, wherein the unit control apparatuses determine the identification information as the optical flow start unit control apparatus if there is no unit control apparatus in the direction away from the emergency exit in association with the selected identification information.

11. The guidance system according to claim 1, wherein the unit control apparatuses is adapted for storing the identification information and the count values set and stored in the adjacent unit control apparatuses, and determines the optical flow unit control apparatus with reference to the stored information of the buffer means.

* * * * *